US008312941B2

(12) United States Patent
Mirchandani et al.

(10) Patent No.: US 8,312,941 B2
(45) Date of Patent: Nov. 20, 2012

(54) MODULAR FIXED CUTTER EARTH-BORING BITS, MODULAR FIXED CUTTER EARTH-BORING BIT BODIES, AND RELATED METHODS

(75) Inventors: Prakash K. Mirchandani, Houston, TX (US); Michale E. Waller, Huntsville, AL (US); Jeffrey L. Weigold, Huntsville, AL (US); Alfred J. Mosco, Spring, TX (US)

(73) Assignee: TDY Industries, LLC, Pittsburgh, PA (US)

( * ) Notice: Subject to any disclaimer, the term of this patent is extended or adjusted under 35 U.S.C. 154(b) by 354 days.

(21) Appl. No.: 11/737,993

(22) Filed: Apr. 20, 2007

(65) Prior Publication Data

US 2007/0251732 A1 Nov. 1, 2007

Related U.S. Application Data

(60) Provisional application No. 60/795,290, filed on Apr. 27, 2006.

(51) Int. Cl.
*E21B 10/62* (2006.01)

(52) U.S. Cl. ..... 175/327; 175/412

(58) Field of Classification Search ..... 175/363, 175/393, 412, 434, 327
See application file for complete search history.

(56) References Cited

U.S. PATENT DOCUMENTS

| | | | |
|---|---|---|---|
| 1,509,438 | A | 9/1924 | Miller |
| 1,530,293 | A | 3/1925 | Breitenstein |
| 1,808,138 | A | 6/1931 | Hogg et al. |
| 1,811,802 | A | 6/1931 | Newman |
| 1,912,298 | A | 5/1933 | Newman |
| 2,054,028 | A | 9/1936 | Benninghoff |
| 2,093,507 | A | 9/1937 | Bartek |
| 2,093,742 | A | 9/1937 | Staples |
| 2,093,986 | A | 9/1937 | Staples |
| 2,240,840 | A | 5/1941 | Fischer |
| 2,246,237 | A | 6/1941 | Benninghoff |
| 2,283,280 | A | 5/1942 | Nell |
| 2,351,827 | A | 6/1944 | McAllister |
| 2,422,994 | A | 6/1947 | Taylor |
| 2,819,958 | A | 1/1958 | Abkowitz et al. |
| 2,819,959 | A | 1/1958 | Abkowitz et al. |
| 2,906,654 | A | 9/1959 | Abkowitz |
| 2,954,570 | A | 10/1960 | Couch |
| 3,041,641 | A | 7/1962 | Hradek et al. |

(Continued)

FOREIGN PATENT DOCUMENTS

| | | |
|---|---|---|
| AU | 695583 | 2/1998 |

(Continued)

OTHER PUBLICATIONS

Metals Handbook, vol. 16 *Machining*, "Tapping" (ASM International 1989), pp. 255-267.

(Continued)

*Primary Examiner* — Brad Harcourt
(74) *Attorney, Agent, or Firm* — K & L Gates LLP; Patrick J. Viccaro; John E. Grosselin, III

(57) ABSTRACT

A modular fixed cutter earth-boring bit body includes a blade support piece and at least one blade piece fastened to the blade support piece. A modular fixed cutter earth-boring bit and methods of making modular fixed cutter earth-boring bit bodies and bits also are disclosed.

14 Claims, 3 Drawing Sheets

U.S. PATENT DOCUMENTS

| | | | |
|---|---|---|---|
| 3,093,850 | A | 6/1963 | Kelso |
| 3,368,881 | A | 2/1968 | Abkowitz et al. |
| 2,299,207 | A | 10/1969 | Bevillard |
| 3,471,921 | A | 10/1969 | Feenstra |
| 3,490,901 | A | 1/1970 | Hachisuka et al. |
| 3,581,835 | A | 6/1971 | Stebley |
| 3,629,887 | A | 12/1971 | Urbanic |
| 3,660,050 | A | 5/1972 | Iler et al. |
| 3,757,879 | A | 9/1973 | Wilder et al. |
| 3,776,655 | A | 12/1973 | Urbanic |
| 3,782,848 | A | 1/1974 | Pfeifer |
| 3,806,270 | A | 4/1974 | Tanner et al. |
| 3,812,548 | A | 5/1974 | Theuerkaue |
| RE28,645 | E | 12/1975 | Aoki et al. |
| 3,942,954 | A | 3/1976 | Frehn |
| 3,987,859 | A | 10/1976 | Lichte |
| 4,009,027 | A | 2/1977 | Naidich et al. |
| 4,017,480 | A | 4/1977 | Baum |
| 4,047,828 | A | 9/1977 | Makely |
| 4,094,709 | A | 6/1978 | Rozmus |
| 4,097,180 | A | 6/1978 | Kwieraga |
| 4,097,275 | A | 6/1978 | Horvath |
| 4,106,382 | A | 8/1978 | Salje et al. |
| 4,126,652 | A | 11/1978 | Oohara et al. |
| 4,128,136 | A | 12/1978 | Generoux |
| 4,170,499 | A | 10/1979 | Thomas et al. |
| 4,198,233 | A | 4/1980 | Frehn |
| 4,221,270 | A | 9/1980 | Vezirian |
| 4,229,638 | A | 10/1980 | Lichte |
| 4,233,720 | A | 11/1980 | Rozmus |
| 4,255,165 | A | 3/1981 | Dennis et al. |
| 4,270,952 | A | 6/1981 | Kobayashi |
| 4,277,106 | A | 7/1981 | Sahley |
| 4,306,139 | A | 12/1981 | Shinozaki et al. |
| 4,311,490 | A | 1/1982 | Bovenkerk et al. |
| 4,325,994 | A | 4/1982 | Kitashima et al. |
| 4,327,156 | A | 4/1982 | Dillon et al. |
| 4,340,327 | A | 7/1982 | Martins |
| 4,341,557 | A | 7/1982 | Lizenby |
| 4,376,793 | A | 3/1983 | Jackson |
| 4,389,952 | A | 6/1983 | Dreier et al. |
| 4,396,321 | A | 8/1983 | Holmes |
| 4,398,952 | A | 8/1983 | Drake |
| 4,478,297 | A | 10/1984 | Radtke |
| 4,499,048 | A | 2/1985 | Hanejko |
| 4,499,795 | A | 2/1985 | Radtke |
| 4,526,748 | A | 7/1985 | Rozmus |
| 4,547,104 | A | 10/1985 | Holmes |
| 4,547,337 | A | 10/1985 | Rozmus |
| 4,550,532 | A | 11/1985 | Fletcher, Jr. et al. |
| 4,552,232 | A | 11/1985 | Frear |
| 4,553,615 | A | 11/1985 | Grainger |
| 4,554,130 | A | 11/1985 | Ecer |
| 4,562,990 | A | 1/1986 | Rose |
| 4,574,011 | A | 3/1986 | Bonjour et al. |
| 4,587,174 | A | 5/1986 | Yoshimura et al. |
| 4,592,685 | A | 6/1986 | Beere |
| 4,596,694 | A | 6/1986 | Rozmus |
| 4,597,730 | A | 7/1986 | Rozmus |
| 4,604,106 | A | 8/1986 | Hall |
| 4,605,343 | A | 8/1986 | Hibbs, Jr. et al. |
| 4,609,577 | A | 9/1986 | Long |
| 4,630,693 | A | 12/1986 | Goodfellow |
| 4,642,003 | A | 2/1987 | Hironori |
| 4,649,086 | A | 3/1987 | Johnson |
| 4,656,002 | A | 4/1987 | Lizenby et al. |
| 4,662,461 | A | 5/1987 | Garrett |
| 4,667,756 | A | 5/1987 | King et al. |
| 4,686,080 | A | 8/1987 | Hara et al. |
| 4,686,156 | A | 8/1987 | Baldoni, II et al. |
| 4,694,919 | A | 9/1987 | Barr |
| 4,708,542 | A | 11/1987 | Emanuelli |
| 4,722,405 | A | 2/1988 | Langford |
| 4,729,789 | A | 3/1988 | Ide et al. |
| 4,734,339 | A | 3/1988 | Schachner et al. |
| 4,743,515 | A | 5/1988 | Fischer et al. |
| 4,744,943 | A | 5/1988 | Timm |
| 4,749,053 | A | 6/1988 | Hollingshead |
| 4,752,159 | A | 6/1988 | Howlett |
| 4,752,164 | A | 6/1988 | Leonard, Jr. |
| 4,779,440 | A | 10/1988 | Cleve et al. |
| 4,809,903 | A | 3/1989 | Eylon et al. |
| 4,813,823 | A | 3/1989 | Bieneck |
| 4,838,366 | A | 6/1989 | Jones |
| 4,861,350 | A | 8/1989 | Phaal et al. |
| 4,871,377 | A | 10/1989 | Frushour |
| 4,881,431 | A | 11/1989 | Bieneck |
| 4,884,477 | A | 12/1989 | Smith et al. |
| 4,889,017 | A | 12/1989 | Fuller et al. |
| 4,899,838 | A | 2/1990 | Sullivan et al. |
| 4,919,013 | A | 4/1990 | Smith et al. |
| 4,923,512 | A | 5/1990 | Timm et al. |
| 4,956,012 | A | 9/1990 | Jacobs et al. |
| 4,968,348 | A | 11/1990 | Abkowitz et al. |
| 4,971,485 | A | 11/1990 | Nomura et al. |
| 4,991,670 | A | 2/1991 | Fuller et al. |
| 5,000,273 | A | 3/1991 | Horton et al. |
| 5,030,598 | A | 7/1991 | Hsieh |
| 5,032,352 | A | 7/1991 | Meeks et al. |
| 5,041,261 | A | 8/1991 | Buljan et al. |
| 5,049,450 | A | 9/1991 | Dorfman et al. |
| RE33,753 | E | 11/1991 | Vacchiano et al. |
| 5,067,860 | A | 11/1991 | Kobayashi et al. |
| 5,090,491 | A | 2/1992 | Tibbitts et al. |
| 5,092,412 | A | 3/1992 | Walk |
| 5,094,571 | A | 3/1992 | Ekerot |
| 5,098,232 | A | 3/1992 | Benson |
| 5,110,687 | A | 5/1992 | Abe et al. |
| 5,112,162 | A | 5/1992 | Hartford et al. |
| 5,112,168 | A | 5/1992 | Glimpel |
| 5,116,659 | A | 5/1992 | Glatzle et al. |
| 5,126,206 | A | 6/1992 | Garg et al. |
| 5,127,776 | A | 7/1992 | Glimpel |
| 5,161,898 | A | 11/1992 | Drake |
| 5,174,700 | A | 12/1992 | Sgarbi et al. |
| 5,179,772 | A | 1/1993 | Braun et al. |
| 5,186,739 | A | 2/1993 | Isobe et al. |
| 5,203,513 | A | 4/1993 | Keller et al. |
| 5,203,932 | A | 4/1993 | Kato et al. |
| 5,232,522 | A | 8/1993 | Doktycz et al. |
| 5,266,415 | A | 11/1993 | Newkirk et al. |
| 5,273,380 | A | 12/1993 | Musacchia |
| 5,281,260 | A | 1/1994 | Kumar et al. |
| 5,286,685 | A | 2/1994 | Schoennahl et al. |
| 5,305,840 | A | 4/1994 | Liang et al. |
| 5,311,958 | A | 5/1994 | Isbell et al. |
| 5,326,196 | A | 7/1994 | Noll |
| 5,333,520 | A | 8/1994 | Fischer et al. |
| 5,348,806 | A | 9/1994 | Kojo et al. |
| 5,354,155 | A | 10/1994 | Adams |
| 5,359,772 | A | 11/1994 | Carlsson et al. |
| 5,373,907 | A | 12/1994 | Weaver |
| 5,376,329 | A | 12/1994 | Morgan et al. |
| 5,423,899 | A | 6/1995 | Krall et al. |
| 5,433,280 | A | 7/1995 | Smith |
| 5,438,858 | A | 8/1995 | Friedrichs |
| 5,443,337 | A | 8/1995 | Katayama |
| 5,452,771 | A | 9/1995 | Blackman et al. |
| 5,467,669 | A | 11/1995 | Stroud |
| 5,479,997 | A | 1/1996 | Scott et al. |
| 5,480,272 | A | 1/1996 | Jorgensen et al. |
| 5,482,670 | A | 1/1996 | Hong |
| 5,484,468 | A | 1/1996 | Östlund et al. |
| 5,487,626 | A | 1/1996 | Von Holst et al. |
| 5,496,137 | A | 3/1996 | Ochayon et al. |
| 5,505,748 | A | 4/1996 | Tank et al. |
| 5,506,055 | A | 4/1996 | Dorfman et al. |
| 5,518,077 | A | 5/1996 | Blackman et al. |
| 5,525,134 | A | 6/1996 | Mehrotra et al. |
| 5,541,006 | A | 7/1996 | Conley |
| 5,543,235 | A | 8/1996 | Mirchandani et al. |
| 5,544,550 | A | 8/1996 | Smith |
| 5,560,440 | A | 10/1996 | Tibbitts |
| 5,570,978 | A | 11/1996 | Rees et al. |
| 5,580,666 | A | 12/1996 | Dubensky et al. |
| 5,586,612 | A | 12/1996 | Isbell et al. |
| 5,590,729 | A | 1/1997 | Cooley et al. |

5,593,474 A 1/1997 Keshavan et al.
5,601,857 A 2/1997 Friedrichs
5,603,075 A 2/1997 Stoll et al.
5,609,447 A 3/1997 Britzke et al.
5,611,251 A 3/1997 Katayama
5,612,264 A 3/1997 Nilsson et al.
5,628,837 A 5/1997 Britzke et al.
RE35,538 E 6/1997 Akesson et al.
5,635,247 A 6/1997 Ruppi
5,641,251 A 6/1997 Leins et al.
5,641,921 A 6/1997 Dennis et al.
5,662,183 A 9/1997 Fang
5,665,431 A 9/1997 Narasimhan
5,666,864 A 9/1997 Tibbitts
5,677,042 A 10/1997 Massa et al.
5,679,445 A 10/1997 Massa et al.
5,686,119 A 11/1997 McNaughton, Jr.
5,697,042 A 12/1997 Massa et al.
5,697,046 A 12/1997 Conley
5,697,462 A 12/1997 Grimes et al.
5,718,948 A 2/1998 Ederyd et al.
5,732,783 A 3/1998 Truax et al.
5,733,649 A 3/1998 Kelley et al.
5,733,664 A 3/1998 Kelley et al.
5,750,247 A 5/1998 Bryant et al.
5,753,160 A 5/1998 Takeuchi et al.
5,755,033 A 5/1998 Günter
5,762,843 A 6/1998 Massa et al.
5,765,095 A 6/1998 Flak et al.
5,776,593 A 7/1998 Massa et al.
5,778,301 A 7/1998 Hong
5,789,686 A 8/1998 Massa et al.
5,792,403 A 8/1998 Massa et al.
5,806,934 A 9/1998 Massa et al.
5,830,256 A 11/1998 Northrop et al.
5,851,094 A 12/1998 Stand et al.
5,856,626 A 1/1999 Fischer et al.
5,863,640 A 1/1999 Ljungberg et al.
5,865,571 A 2/1999 Tankala et al.
5,873,684 A 2/1999 Flolo
5,880,382 A 3/1999 Fang et al.
5,890,852 A 4/1999 Gress
5,897,830 A 4/1999 Abkowitz et al.
5,947,660 A 9/1999 Karlsson et al.
5,957,006 A 9/1999 Smith
5,963,775 A 10/1999 Fang
5,964,555 A 10/1999 Strand
5,967,249 A 10/1999 Butcher
5,971,670 A 10/1999 Pantzar et al.
5,976,707 A 11/1999 Grab et al.
5,988,953 A 11/1999 Berglund et al.
6,007,909 A 12/1999 Rolander et al.
6,022,175 A 2/2000 Heinrich et al.
6,029,544 A 2/2000 Katayama
6,051,171 A 4/2000 Takeuchi et al.
6,063,333 A 5/2000 Dennis
6,068,070 A 5/2000 Scott
6,073,518 A 6/2000 Chow et al.
6,076,999 A 6/2000 Hedberg et al.
6,086,003 A 7/2000 Günter et al.
6,086,980 A 7/2000 Foster et al.
6,089,123 A 7/2000 Chow et al.
6,148,936 A 11/2000 Evans et al.
6,200,514 B1 3/2001 Meister
6,209,420 B1 4/2001 Butcher et al.
6,214,134 B1 4/2001 Eylon et al.
6,214,247 B1 4/2001 Leverenz et al.
6,214,287 B1 4/2001 Waldenström
6,217,992 B1 4/2001 Grab
6,220,117 B1 4/2001 Butcher
6,227,188 B1 5/2001 Tankala et al.
6,228,139 B1 5/2001 Oskarrson
6,241,036 B1 6/2001 Lovato et al.
6,248,277 B1 6/2001 Friedrichs
6,254,658 B1 7/2001 Taniuchi et al.
6,287,360 B1 9/2001 Kembaiyan et al.
6,290,438 B1 9/2001 Papajewski
6,293,986 B1 9/2001 Rödiger et al.
6,299,658 B1 10/2001 Moriguchi et al.
6,353,771 B1 3/2002 Southland
6,372,346 B1 4/2002 Toth
6,374,932 B1 4/2002 Brady
6,375,706 B2 4/2002 Kembaiyan et al.
6,386,954 B2 5/2002 Sawabe et al.
6,395,108 B2 5/2002 Eberle et al.
6,402,439 B1 6/2002 Puide et al.
6,425,716 B1 7/2002 Cook
6,450,739 B1 9/2002 Puide et al.
6,453,899 B1 9/2002 Tselesin
6,454,025 B1 9/2002 Runquist et al.
6,454,028 B1 9/2002 Evans
6,454,030 B1 9/2002 Findley et al.
6,458,471 B2 10/2002 Lovato et al.
6,461,401 B1 10/2002 Kembaiyan et al.
6,474,425 B1 11/2002 Truax et al.
6,499,917 B1 12/2002 Parker et al.
6,499,920 B2 12/2002 Sawabe
6,500,226 B1 12/2002 Dennis
6,502,623 B1 1/2003 Schmitt
6,511,265 B1 1/2003 Mirchandani et al.
6,544,308 B2 4/2003 Griffin et al.
6,551,035 B1 4/2003 Bruhn et al.
6,554,548 B1 4/2003 Grab et al.
6,562,462 B2 5/2003 Griffin et al.
6,576,182 B1 6/2003 Ravagni et al.
6,585,064 B2 7/2003 Griffin et al.
6,589,640 B2 7/2003 Griffin et al.
6,599,467 B1 7/2003 Yamaguchi et al.
6,607,693 B1 8/2003 Saito et al.
6,620,375 B1 9/2003 Tank et al.
6,638,609 B2 10/2003 Nordgren et al.
6,655,481 B2 12/2003 Findley et al.
6,676,863 B2 1/2004 Christiaens et al.
6,685,880 B2 2/2004 Engström et al.
6,688,988 B2 2/2004 McClure
6,695,551 B2 2/2004 Silver
6,706,327 B2 3/2004 Blomstedt et al.
6,716,388 B2 4/2004 Bruhn et al.
6,719,074 B2 4/2004 Tsuda et al.
6,723,389 B2 4/2004 Kobayashi et al.
6,737,178 B2 5/2004 Ota et al.
6,742,608 B2 6/2004 Murdoch
6,742,611 B1 6/2004 Illerhaus et al.
6,756,009 B2 6/2004 Sim et al.
6,764,555 B2 7/2004 Hiramatsu et al.
6,766,870 B2 7/2004 Overstreet
6,808,821 B2 10/2004 Fujita et al.
6,844,085 B2 1/2005 Takayama et al.
6,849,231 B2 2/2005 Kojima et al.
6,884,496 B2 4/2005 Westphal et al.
6,892,793 B2 5/2005 Liu et al.
6,899,495 B2 5/2005 Hansson et al.
6,918,942 B2 7/2005 Hatta et al.
6,948,890 B2 9/2005 Svensson et al.
6,949,148 B2 9/2005 Sugiyama et al.
6,955,233 B2 10/2005 Crowe et al.
6,958,099 B2 10/2005 Nakamura et al.
7,014,719 B2 3/2006 Suzuki et al.
7,014,720 B2 3/2006 Iseda
7,044,243 B2 5/2006 Kembaiyan et al.
7,048,081 B2 5/2006 Smith et al.
7,070,666 B2 7/2006 Druschitz et al.
7,090,731 B2 8/2006 Kashima et al.
7,101,128 B2 9/2006 Hansson
7,101,446 B2 9/2006 Takeda et al.
7,125,207 B2 10/2006 Craig et al.
7,128,773 B2 10/2006 Liang et al.
7,147,413 B2 12/2006 Henderer et al.
7,175,404 B2 2/2007 Kondo et al.
7,238,414 B2 7/2007 Benitsch et al.
7,244,519 B2 7/2007 Festeau et al.
7,250,069 B2 7/2007 Kembaiyan et al.
7,261,782 B2 8/2007 Hwang et al.
7,267,543 B2 9/2007 Freidhoff et al.
7,270,679 B2 9/2007 Istephanous et al.
7,296,497 B2 11/2007 Kugelberg et al.
7,381,283 B2 6/2008 Lee et al.
7,384,413 B2 6/2008 Gross et al.

| | | | | |
|---|---|---|---|---|
| 7,410,610 | B2 | 8/2008 | Woodfield et al. | |
| 7,497,396 | B2 | 3/2009 | Splinter et al. | |
| 7,524,351 | B2 | 4/2009 | Hua et al. | |
| 7,575,620 | B2 | 8/2009 | Terry et al. | |
| 7,625,157 | B2 | 12/2009 | Prichard et al. | |
| 7,954,569 | B2 | 6/2011 | Mirchandani et al. | |
| 8,025,112 | B2 | 9/2011 | Mirchandani et al. | |
| 2002/0004105 | A1 | 1/2002 | Kunze et al. | |
| 2003/0010409 | A1 | 1/2003 | Kunze et al. | |
| 2003/0041922 | A1 | 3/2003 | Hirose et al. | |
| 2003/0219605 | A1 | 11/2003 | Molian et al. | |
| 2004/0013558 | A1 | 1/2004 | Kondoh et al. | |
| 2004/0045743 | A1* | 3/2004 | Lockstedt et al. | 175/374 |
| 2004/0105730 | A1 | 6/2004 | Nakajima | |
| 2004/0129403 | A1 | 7/2004 | Liu et al. | |
| 2004/0185948 | A1 | 9/2004 | Muller | |
| 2004/0228695 | A1 | 11/2004 | Clauson | |
| 2004/0234820 | A1 | 11/2004 | Majagi | |
| 2004/0245022 | A1 | 12/2004 | Izaguirre et al. | |
| 2004/0245024 | A1* | 12/2004 | Kembaiyan | 175/425 |
| 2005/0008524 | A1 | 1/2005 | Testani | |
| 2005/0025928 | A1 | 2/2005 | Annanolli et al. | |
| 2005/0084407 | A1 | 4/2005 | Myrick | |
| 2005/0103404 | A1 | 5/2005 | Hsieh et al. | |
| 2005/0117984 | A1 | 6/2005 | Eason et al. | |
| 2005/0126334 | A1* | 6/2005 | Mirchandani | 75/240 |
| 2005/0194073 | A1 | 9/2005 | Hamano et al. | |
| 2005/0211475 | A1 | 9/2005 | Mirchandani et al. | |
| 2005/0247491 | A1 | 11/2005 | Mirchandani et al. | |
| 2005/0268746 | A1 | 12/2005 | Abkowitz et al. | |
| 2006/0016521 | A1 | 1/2006 | Hanusiak et al. | |
| 2006/0024140 | A1 | 2/2006 | Wolff et al. | |
| 2006/0032677 | A1 | 2/2006 | Azar et al. | |
| 2006/0043648 | A1 | 3/2006 | Takeuchi et al. | |
| 2006/0060392 | A1 | 3/2006 | Eyre | |
| 2006/0131081 | A1 | 6/2006 | Mirchandani et al. | |
| 2006/0286410 | A1 | 12/2006 | Ahigren et al. | |
| 2006/0288820 | A1 | 12/2006 | Mirchandani et al. | |
| 2007/0042217 | A1 | 2/2007 | Fang et al. | |
| 2007/0082229 | A1 | 4/2007 | Mirchandani et al. | |
| 2007/0102198 | A1 | 5/2007 | Oxford et al. | |
| 2007/0102199 | A1 | 5/2007 | Smith et al. | |
| 2007/0102200 | A1 | 5/2007 | Choe et al. | |
| 2007/0102202 | A1 | 5/2007 | Choe et al. | |
| 2007/0108650 | A1 | 5/2007 | Mirchandani et al. | |
| 2007/0126334 | A1 | 6/2007 | Nakamura et al. | |
| 2007/0163679 | A1 | 7/2007 | Fujisawa et al. | |
| 2007/0193782 | A1 | 8/2007 | Fang et al. | |
| 2008/0011519 | A1 | 1/2008 | Smith et al. | |
| 2008/0101977 | A1 | 5/2008 | Eason et al. | |
| 2008/0145686 | A1 | 6/2008 | Mirchandani et al. | |
| 2008/0163723 | A1 | 7/2008 | Mirchandani et al. | |
| 2008/0196318 | A1 | 8/2008 | Bost et al. | |
| 2008/0226943 | A1 | 9/2008 | Fang et al. | |
| 2008/0302576 | A1 | 12/2008 | Mirchandani et al. | |
| 2009/0041612 | A1 | 2/2009 | Fang et al. | |
| 2009/0136308 | A1 | 5/2009 | Newitt | |
| 2009/0180915 | A1 | 7/2009 | Mirchandani et al. | |
| 2009/0293672 | A1 | 12/2009 | Mirchandani et al. | |
| 2010/0044114 | A1 | 2/2010 | Mirchandani et al. | |
| 2010/0044115 | A1 | 2/2010 | Mirchandani et al. | |
| 2010/0278603 | A1 | 11/2010 | Fang et al. | |
| 2010/0290849 | A1 | 11/2010 | Mirchandani et al. | |
| 2010/0303566 | A1 | 12/2010 | Fang et al. | |
| 2011/0011965 | A1 | 1/2011 | Mirchandani et al. | |
| 2011/0265623 | A1 | 11/2011 | Mirchandani et al. | |
| 2011/0290566 | A1 | 12/2011 | Mirchandani et al. | |

FOREIGN PATENT DOCUMENTS

| | | | |
|---|---|---|---|
| CA | 2212197 | | 10/2000 |
| EP | 0157625 | A2 | 10/1985 |
| EP | 0264674 | A2 | 4/1988 |
| EP | 0453428 | A1 | 10/1991 |
| EP | 0 641 620 | B1 | 2/1998 |
| EP | 0995876 | A2 | 4/2000 |
| EP | 1065021 | A1 | 1/2001 |
| EP | 1066901 | A2 | 1/2001 |
| EP | 1077783 | B1 | 2/2001 |
| EP | 1106706 | A1 | 6/2001 |
| EP | 0759480 | B1 | 1/2002 |
| EP | 1244531 | B1 | 10/2004 |
| EP | 1686193 | A2 | 8/2006 |
| EP | 1198609 | B2 | 10/2007 |
| FR | 2 627 541 | A2 | 8/1989 |
| GB | 622041 | | 4/1949 |
| GB | 945227 | | 12/1963 |
| GB | 1082568 | | 9/1967 |
| GB | 1309634 | | 3/1973 |
| GB | 1420906 | | 1/1976 |
| GB | 1491044 | | 11/1977 |
| GB | 2158744 | A | 11/1985 |
| GB | 2218931 | A | 11/1989 |
| GB | 2 324 752 | A | 11/1998 |
| GB | 2352727 | A | 2/2001 |
| GB | 2385350 | A | 8/2003 |
| GB | 2393449 | A | 3/2004 |
| GB | 2 397 832 | A | 8/2004 |
| GB | 2435476 | A | 8/2007 |
| JP | 51-124876 | A | 10/1976 |
| JP | 59-169707 | A | 9/1984 |
| JP | 59-175912 | A | 10/1984 |
| JP | 60-48207 | A | 3/1985 |
| JP | 60-172403 | A | 9/1985 |
| JP | 61-243103 | A | 10/1986 |
| JP | 61057123 | B | 12/1986 |
| JP | 62-34710 | A | 2/1987 |
| JP | 62-063005 | A | 3/1987 |
| JP | 62-218010 | A | 9/1987 |
| JP | 2-95506 | A | 4/1990 |
| JP | 2-269515 | A | 11/1990 |
| JP | 3-43112 | A | 2/1991 |
| JP | 3-73210 | A | 3/1991 |
| JP | 5-50314 | A | 3/1993 |
| JP | 5-92329 | A | 4/1993 |
| JP | H05-64288 | U | 8/1993 |
| JP | H03-119090 | U | 6/1995 |
| JP | 8-120308 | A | 5/1996 |
| JP | H8-209284 | | 8/1996 |
| JP | 10219385 | A | 8/1998 |
| JP | 11-300516 | A | 11/1999 |
| JP | 2000-355725 | A | 12/2000 |
| JP | 2002-097885 | A | 4/2002 |
| JP | 2002-166326 | A | 6/2002 |
| JP | 02254144 | A | 9/2002 |
| JP | 2002-317596 | A | 10/2002 |
| JP | 2003-306739 | A | 10/2003 |
| JP | 2004-160591 | A | 6/2004 |
| JP | 2004-181604 | | 7/2004 |
| JP | 2004-190034 | A | 7/2004 |
| JP | 2005-111581 | A | 4/2005 |
| RU | 2135328 | C1 | 8/1999 |
| SU | 1269922 | A | 11/1986 |
| SU | 1292817 | A1 | 2/1987 |
| SU | 1350322 | | 11/1987 |
| WO | WO 92/05009 | A1 | 4/1992 |
| WO | WO 92/22390 | A1 | 12/1992 |
| WO | WO 98/28455 | A1 | 7/1998 |
| WO | WO 99/13121 | A1 | 3/1999 |
| WO | WO 00/043628 | | 7/2000 |
| WO | WO 00/52217 | A1 | 9/2000 |
| WO | WO 00/73532 | A1 | 12/2000 |
| WO | WO 01/43899 | A1 | 6/2001 |
| WO | WO 03/010350 | A1 | 2/2003 |
| WO | WO 03/011508 | A2 | 2/2003 |
| WO | WO 03/049889 | A2 | 6/2003 |
| WO | WO 2004/053197 | A2 | 6/2004 |
| WO | WO 2005/045082 | A1 | 5/2005 |
| WO | WO 2005/054530 | A1 | 6/2005 |
| WO | WO 2005/061746 | A1 | 7/2005 |
| WO | WO 2005/106183 | A1 | 11/2005 |
| WO | WO 2006/071192 | A1 | 7/2006 |
| WO | WO 2006/104004 | A1 | 10/2006 |
| WO | WO 2007/001870 | A2 | 1/2007 |
| WO | WO 2007/022336 | A2 | 2/2007 |
| WO | WO 2007/030707 | A1 | 3/2007 |
| WO | WO 2007/044791 | A1 | 4/2007 |
| WO | WO 2007/127680 | A1 | 11/2007 |

| | | | |
|---|---|---|---|
| WO | WO 2008/098636 | A1 | 6/2008 |
| WO | WO 2008/115703 | A1 | 9/2008 |
| WO | WO 2011/008439 | A2 | 1/2011 |

OTHER PUBLICATIONS

Metals Handbook, vol. 16 *Machining*, "Cemented Carbides" (ASM International 1989), pp. 71-89.
U.S. 4,966,627, Oct. 30, 1990, Keshaven et al.
Coyle, T.W. and A. Bahrami, "Structure and Adhesion of Ni and Ni-WC Plasma Spray Coatings," Thermal Spray, Surface Engineering via Applied Research, Proceedings of the 1st International Thermal Spray Conference, May 8-11, 2000, Montreal, Quebec, Canada, 2000, pp. 251-254.
Deng, X. et al., "Mechanical Properties of a Hybrid Cemented Carbide Composite," International Journal of Refractory Metals and Hard Materials, Elsevier Science Ltd., vol. 19, 2001, pp. 547-552.
Gurland, J. , *Quantitative Microscopy*, R.T. DeHoff and F.N. Rhines, eds., McGraw-Hill Book Company, New York, 1968, pp. 278-289.
Gurland, Joseph, "Application of Quantitative Microscopy to Cemented Carbides," Practical Applications of Quantitative Matellography, ASTM Special Technical Publication 839, ASTM 1984, pp. 65-84.
Hayden, Matthew and Lyndon Scott Stephens, "Experimental Results for a Heat-Sink Mechanical Seal," Tribology Transactions, 48, 2005, pp. 352-361.
Peterman, Walter, "Heat-Sink Compound Protects the Unprotected," Welding Design and Fabrication, Sep. 2003, pp. 20-22.
Sriram, et al., "Effect of Cerium Addition on Microstructures of Carbon-Alloyed Iron Aluminides," Bull. Mater. Sci., vol. 28, No. 6, Oct. 2005, pp. 547-554.
Tracey et al., "Development of Tungsten Carbide-Cobalt-Ruthenium Cutting Tools for Machining Steels" Proceedings Annual Microprogramming Workshop, vol. 14, 1981, pp. 281-292.
Underwood, *Quantitative Stereology*, pp. 23-108 (1970).
Notice of Allowance issued on Nov. 26, 2008 in U.S. Appl. No. 11/013,842.
Office Action issued on Jul. 16, 2008 in U.S. Appl. No. 11/013,842.
Office Action issued on Jul. 30, 2007 in U.S. Appl. No. 11/013,842.
Office Action issued on Jan. 16, 2007 in U.S. Appl. No. 11/013,842.
Notice of Allowance issued on Oct. 21, 2002 in U.S. Appl. No. 09/460,540.
Office Action issued on Jun. 18, 2002 in U.S. Appl. No. 09/460,540.
Office Action issued on Mar. 12, 2009 in U.S. Appl. No. 11/585,408.
Office Action issued on Jan. 24, 2008 in U.S. Appl. No. 10/848,437.
Office Action issued on May 7, 2007 in U.S. Appl. No. 10/848,437.
Pre-Appeal Brief Conference Decision issued on May 14, 2008 in U.S. Appl. No. 10/848,437.
Restriction Requirement issued on Sep. 8, 2006 in U.S. Appl. No. 10/848,437.
Notice of Allowance issued on Nov. 13, 2008 in U.S. Appl. No. 11/206,368.
Pre-Appeal Conference Decision issued on Jun. 19, 2008 in U.S. Appl. No. 11/206,368.
Office Action issued on Feb. 28, 2008 in U.S. Appl. No. 11/206,368.
Office Action issued on Aug. 31, 2007 in U.S. Appl. No. 11/206,368.
Notice of Allowance issued on Jan. 27, 2009 in U.S. Appl. No. 11/116,752.
Office Action issued on Aug. 12, 2008 in U.S. Appl. No. 11/116,752.
Office Action issued on Jul. 9, 2009 in U.S. Appl. No. 11/116,752.
Office Action issued on Jan. 15, 2008 in U.S. Appl. No. 11/116,752.
Office Action issued on May 29, 2007 in U.S. Appl. No. 11/116,752.
Office Action issued on Oct. 21, 2008 in U.S. Appl. No. 11/167,811.
Restriction Requirement issued on Jul. 24, 2008 in U.S. Appl. No. 11/167,811.
Office Action mailed Oct. 13, 2006 in U.S. Appl. No. 10/922,750.
Advisory Action issued Mar. 15, 2002 in U.S. Appl. No. 09/460,540.
Final Office Action issued Jun. 12, 2009 in U.S. Appl. No. 11/167,811.
Office Action issued Aug. 28, 2009 in U.S. Appl. No. 11/167,811.
Supplemental Notice of Allowability issued Jul. 3, 2007 for U.S. Appl. No. 10/922,750.
Notice of Allowance issued May 21, 2007 for U.S. Appl. No. 10/922,750.
Office Action issued Mar. 12, 2009 in U.S. Appl. No. 11/585,408.
Office Action issued Jun. 1, 2001 in U.S. Appl. No. 09/460,540.
Office Action issued Dec. 1, 2001 in U.S. Appl. No. 09/460,540.
U.S. Appl. No. 12/196,815, filed Aug. 22, 2008, (61 pages).
U.S. Appl. No. 12/476,738, filed Jun. 2, 2009, (31 pages).
U.S. Appl. No. 12/196,951, filed Aug. 22, 2008, (51 pages).
Shi et al., "Composite Ductility—The Role of Reinforcement and Matrix", TMS Meeting, Las Vegas, NV, Feb. 12-16, 1995, 10 pages.
Vander Vort, "Introduction to Quantitative Metallography", Tech Notes, vol. 1, Issue 5, published by Buehler, Ltd. 1997, 6 pages.
You Tube, "The Story Behind Kennametal's Beyond Blast", dated Sep. 14, 2010, http://www.youtube.com/watch?v=8_A-bYVwmU8 (3 pages) accessed on Oct. 14, 2010.
Kennametal press release on Jun. 10, 2010, http://news.thomasnet.com/companystory/Kennametal-Launches-Beyond-BLAST-TM-at-IMTS-2010-Booth-W-1522-833445 (2 pages) accessed on Oct. 14, 2010.
Pages from Kennametal site, https://www.kennametal.com/en-US/promotions/Beyond_Blast.jhtml (7 pages) accessed on Oct. 14, 2010.
ASM Materials Engineering Dictionary, J.R. Davis, Ed., ASM International, Fifth printing, Jan. 2006, p. 98.
Childs et al., "Metal Machining", 2000, Elsevier, p. 111.
Brookes, Kenneth J. A., "World Directory and Handbook of Hardmetals and Hard Materials", International Carbide Data, U.K. 1996, Sixth Edition, p. 42.
Firth Sterling grade chart, Allegheny Technologies, attached to Declaration of Prakash Mirchandani, Ph.D. as filed in U.S. Appl. No. 11/737,993 on Sep. 9, 2009.
Metals Handbook Desk Edition, 2nd Ed., J.R. Davis, Editor, ASM International 1998, p. 62.
McGraw-Hill Dictionary of Scientific and Technical Terms, 5th Edition, Sybil P. Parker, Editor in Chief, 1993, pp. 799, 800, 1933, and 2047.
Office Action mailed Sep. 22, 2009 in U.S. Appl. No. 11/585,408.
Office Action mailed Sep. 7, 2010 in U.S. Appl. No. 11/585,408.
Office Action mailed Feb. 16, 2011 in U.S. Appl. No. 11/585,408.
Advisory Action mailed May 3, 2011 in U.S. Appl. No. 11/585,408.
Office Action mailed Mar. 2, 2010 in U.S. Appl. No. 11/167,811.
Office Action mailed Aug. 19, 2010 in U.S. Appl. No. 11/167,811.
Advisory Action Before the Filing of an Appeal Brief mailed May 12, 2010 in U.S. Appl. No. 11/167,811.
Office Action mailed Feb. 3, 2011 in U.S. Appl. No. 11/167,811.
Advisory Action mailed May 11, 2011 in U.S. Appl. No. 11/167,811.
Restriction Requirement mailed Sep. 17, 2010 in U.S. Appl. No, 12/397,597.
Office Action mailed Nov. 15, 2010 in U.S. Appl. No. 12/397,597.
Office Action mailed May 3, 2010 in U.S. Appl. No. 11/924,273.
Office Action mailed Oct. 14, 2010 in U.S. Appl. No. 11/924,273.
Office Action mailed Feb. 2, 2011 in U.S. Appl. No. 11/924,273.
Office Action mailed May 14, 2009 in U.S. Appl. No. 11/687,343.
Office Action mailed Jan. 21, 2010 in U.S. Appl. No. 11/687,343.
Notice of Allowance mailed May 18, 2010 in U.S. Appl. No. 11/687,343.
Office Action mailed Dec. 29, 2005 in U.S. Appl. No. 10/903,198.
Office Action mailed Sep. 29, 2006 in U.S. Appl. No. 10/903,198.
Office Action mailed Mar. 27, 2007 in U.S. Appl. No. 10/903,198.
Office Action mailed Sep. 26, 2007 in U.S. Appl. No. 10/903,198.
Office Action mailed Jan. 16, 2008 in U.S. Appl. No. 10/903,198.
Office Action mailed Oct. 31, 2008 in U.S. Appl. No. 10/903,198.
Office Action mailed Apr. 17, 2009 in U.S. Appl. No. 10/903,198.
Advisory Action before mailing of Appeal Brief mailed Jun. 29, 2009 in U.S. Appl. No. 10/903,198.
Examiner's Answer mailed Aug. 17, 2010 in U.S. Appl. No. 10/903,198.
Office Action mailed Apr. 22, 2010 in U.S. Appl. No. 12/196,951.
Office Action mailed Oct. 29, 2010 in U.S. Appl. No. 12/196,951.
Office Action mailed Apr. 12, 2011 in U.S. Appl. No. 12/196,951.
Restriction Requirement mailed Aug. 4, 2010 in U.S. Appl. No. 12/196,815.
Office Action mailed Oct. 27, 2010 in U.S. Appl. No. 12/196,815.

Office Action mailed Nov. 17, 2010 in U.S. Appl. No. 12/196,815.
Notice of Allowance mailed Jan. 27, 2011 in U.S. Appl. No. 12/196,815.
Notice of Allowance mailed May 16, 2011 in U.S. Appl. No. 12/196,815.
Office Action mailed Apr. 30, 2009 in U.S. Appl. No. 11/206,368.
Notice of Allowance mailed Nov. 30, 2009 in U.S. Appl. No. 11/206,368.
ProKon Version 8.8, The Calculation Companion, Properties for W, Ti, Mo, Co, Ni and FE, Copyright 1997-1998, 6 pages.
TIBTECH Innovations, "Properties table of stainless steel, metals and other conductive materials", printed from http://www.tibtech.com/conductivity.php on Aug. 19, 2011, 1 page.
"Material: Tungsten Carbide (WC), bulk", MEMSnet, printed from http://www.memsnet.org/material/tungstencarbidewcbulk/ on Aug. 19, 2001, 1 page.
Williams, Wendell S., "The Thermal Conductivity of Metallic Ceramics", JOM, Jun. 1998 pp. 62-66.
Brookes, Kenneth J. A., "World Directory and Handbook of Hardmetals and Hard Materials", International Carbide Data, U.K, 1996, Sixth Edition, pp. D182-D184.
Thermal Conductivity of Metals, The Engineering ToolBox, printed from http://www.engineeringtoolbox.com/thermal-conductivity-metals-d_858.html on Oct. 27, 2011, 3 pages.
Shing et al., "The effect of ruthenium additions on hardness, toughness and grain size of WC-Co." Int. J. of Refractory Metals & Hard Materials, vol. 19, pp. 41-44, 2001.
Biernat, "Coating can greatly enhance carbide tool life and performance, but only if they stay in place." Cutting Tool Engineering, 47(2), Mar. 1995.
Brookes, World Dictionary and Handbook of Hardmetals and Hard Materials, International Carbide Data, Sixth edition, 1998, p. D194.
Tonsnoff et al., "Surface treatment of cutting tool substrates," Int. J. Tools Manufacturing, 38(5-6), 1998. 469-476.
Bouzakis et al., "Improvement of PVD Coated inserts Cutting Performance Through Appropriate Mechanical Treatments of Substrate and Coating Surface", Surface and Coatings Technology, 2001, 148-174; pp. 443-490.
Destefani, "Cutting tools 101: Coatings," Manufacturing, Engineering, 129(4), 2002, 5 pages.
Santhanam, et al., "Comparison of the Steel-Milling Performance of Carbide Inserts with MTCVD and PVD TICN Coatings", Int J. of Refractory Metals & Hard Materials, vol, 14, 1996, pp. 31-40.
Wolfe et al., "The Role of Hard Coating in Carbide Milling Tools", J. Vacuum Science Technology, vol. 4, No. 6, Nov./Dec. 1986, pp. 2747-2754.
Quinto, "Mechanical Property and Structure Relationships in Hard Coatings for Cutting Tools", J. Vacuum Science Technology, vol. 6, No. 3, May/Jun. 1988, pp. 2149-2157.
The Thermal Conductivity of Some Common Materials and Gases, The Engineering ToolBox, printed from http://www.engineeringtoolbox.com/thermal-conductivity-d_429.html on Dec. 15, 2011, 4 pages.
Office Action mailed Aug. 17, 2011 in U.S. Appl. No. 11/585,408.
Notice of Allowance mailed May 9, 2012 in U.S. Appl. No. 11/585,408.
Office Action mailed Jul. 22, 2011 in U.S. Appl. No. 11/167,811.
Office Aciton mailed Mar. 28, 2012 in U.S. Appl. No. 11/167,811.
Office Action mailed Jun. 7, 2011 in U.S. Appl. No. 12/397,597.
Advisory Action Before the Filing of an Appeal Brief mailed Aug. 31, 2011 in U.S. Appl. No. 12/397,597.
Office Action mailed Nov. 17, 2011 in U.S. Appl. No. 12/397,597.
Advisory Action mailed Jan. 26, 2012 in U.S. Appl. No. 12/397,597.
Office Action mailed Apr. 13, 2012 in U.S. Appl. No. 12/397,597.
Office Action mailed Oct. 19, 2011 in U.S. Appl. No, 12/196,951.
Office Action mailed Mar. 19, 2012 in U.S. Appl. No. 12/196,951.
Office Action Mailed Oct. 13, 2011 in U.S. Appl. No. 12/179,999.
Notice of Allowance mailed Apr. 30, 2012 in U.S. Appl. No. 12/179,999.
Office Action mailed Aug. 29, 2011 in U.S. Appl. No. 12/476,738.
Office Action mailed Dec. 21, 2011 in U.S. Appl. No. 12/476,738.
Notice of Allowance mailed Apr. 17, 2012 in U.S. Appl. No. 12/476,738.
Office Action mailed Nov. 14, 2011 in U.S. Appl. No. 12/502,277.
Office Action mailed Jan. 20, 2012 in U.S. Appl. No. 12/502,277.
Office Action mailed Mar. 15, 2012 in U.S. Appl. No. 12/464,607.
Notice of Allowance maiied Apr. 9, 2012 in U.S. Appl. No. 12/464,607.
Office Action mailed Oct. 31, 2011 in U.S. Appl. No. 13/207,478.
Office Action mailed Mar. 2, 2012 in U.S. Appl. No. 13/207,478.
Notice of Allowance mailed Apr. 13, 2012 in U.S. Appl. No. 13/207,476.
Office Action mailed Dec. 5, 2011 in U.S. Appl. No. 13/182,474.
Office Acton mailed Apr. 27, 2012 in U.S. Appl. No. 13/182,474.
Office Action mailed Sep. 2, 2011 in U.S. Appl. No. 12/850,003.
Notice of Allowance mailed Nov. 15, 2011 in U.S. Appl. No. 12/850,003.
Interview Summary mailed Feb. 16, 2011 in U.S. Appl. No. 11/924,273.
Interview Summary mailed May 9, 2011 in U.S. Appl. No. 11/924,273.
Notice of Allowance mailed Jun. 24, 2011 in U.S. Appl. No. 11/924,273.

* cited by examiner

MODULAR FIXED CUTTER EARTH-BORING BITS, MODULAR FIXED CUTTER EARTH-BORING BIT BODIES, AND RELATED METHODS

CROSS-REFERENCE TO RELATED APPLICATIONS

The present application claims priority under 35 U.S.C. §119(e) to U.S. provisional patent application Ser. No. 60/795,290, filed Apr. 27, 2006.

TECHNICAL FIELD OF INVENTION

The present invention relates, in part, to improvements to earth-boring bits and methods of producing earth-boring bits. The present invention further relates to modular earth-boring bit bodies and methods of forming modular earth-boring bit bodies.

BACKGROUND OF THE TECHNOLOGY

Earth-boring bits may have fixed or rotatable cutting elements. Earth-boring bits with fixed cuffing elements typically include a bit body machined from steel or fabricated by infiltrating a bed of hard particles, such as cast carbide (WC+$W_2C$), macrocystalline or standard tungsten carbide (WC), and/or sintered cemented carbide with a copper-base alloy binder. Conventional fixed cutting element earth-boring bits comprise a one-piece bit body with several cutting inserts in insert pockets located on the bit body in a manner designed to optimize cutting. It is important to maintain the inserts in precise locations to optimize drilling efficiency, avoid vibrations, and minimize stresses in the bit body in order to maximize the life of the earth-boring bit. The cutting inserts are often based on highly wear resistant materials such as diamond. For example, cutting inserts may consist of a layer of synthetic diamond placed on a cemented carbide substrate, and such inserts are often referred to as polycrystalline diamond compacts (PDC). The bit body may be secured to a steel shank that typically includes a threaded pin connection by which the bit is secured to a drive shaft of a downhole motor or a drill collar at the distal end of a drill string. In addition, drilling fluid or mud may be pumped down the hollow drill string and out nozzles formed in the bit body. The drilling fluid or mud cools and lubricates the bit as it rotates and also carries material cut by the bit to the surface.

Conventional earth-boring bit bodies have typically been made in one of the following ways, for example, machined from a steel blank or fabricated by infiltrating a bed of hard carbide particles placed within a mold with a copper based binder alloy. Steel-bodied bits are typically machined from round stock to a desired shape, with topographical and internal features. After machining the bit body, the surface may be hard-faced to apply wear-resistant materials to the face of the bit body and other critical areas of the surface of the bit body.

In the conventional method for manufacturing a bit body from hard particles and a binder, a mold is milled or machined to define the exterior surface features of the bit body. Additional hand milling or clay work may also be required to create or refine topographical features of the bit body.

Once the mold is complete, a preformed bit blank of steel may be disposed within the mold cavity to internally reinforce the bit body matrix upon fabrication. Other transition or refractory metal based inserts, such as those defining internal fluid courses, pockets for cutting elements, ridges, lands, nozzle displacements, junk slots, or other internal or topographical features of the bit body, may also be inserted into the cavity of the mold. Any inserts used must be placed at precise locations to ensure proper positioning of cuffing elements, nozzles, junk slots, etc., in the final bit.

The desired hard particles may then be placed within the mold and packed to the desired density. The hard particles are then infiltrated with a molten binder, which freezes to form a solid bit body including a discontinuous phase of hard particles within a continuous phase of binder.

The bit body may then be assembled with other earth-boring bit components. For example, a threaded shank may be welded or otherwise secured to the bit body, and cutting elements or inserts (typically diamond or a synthetic polycrystalline diamond compact ("PDC")) are secured within the cutting insert pockets, such as by brazing, adhesive bonding, or mechanical affixation. Alternatively, the cutting inserts may be bonded to the face of the bit body during furnacing and infiltration if thermally stable PDC's ("TSP") are employed.

The bit body and other elements of earth-boring bits are subjected to many forms of wear as they operate in the harsh down hole environment. Among the most common form of wear is abrasive wear caused by contact with abrasive rock formations. In addition, the drilling mud, laden with rock cuttings, causes the bit to erode or wear.

The service life of an earth-boring bit is a function not only of the wear properties of the PDCs or cemented carbide inserts, but also of the wear properties of the bit body (in the case of fixed cutter bits) or conical holders (in the case of roller cone bits). One way to increase earth-boring bit service life is to employ bit bodies made of materials with improved combinations of strength, toughness, and abrasion/erosion resistance.

Recently, it has been discovered that fixed-cutter bit bodies may be fabricated from cemented carbides employing standard powder metallurgy practices (powder consolidation, followed by shaping or machining the green or presintered powder compact, and high temperature sintering). Such solid, one-piece, cemented carbide based bit bodies are described in U.S. Patent Publication No. 2005/0247491.

In general, cemented carbide based bit bodies provide substantial advantages over the bit bodies of the prior art (machined from steel or infiltrated carbides) since cemented carbides offer vastly superior combinations of strength, toughness, as well as abrasion and erosion resistance compared to steels or infiltrated carbides with copper based binders. FIG. 1 shows a typical solid, one-piece, cemented carbide bit body 10 that can be employed to make a PDC-based earth boring bit. As can be observed, the bit body 10 essentially consists of a central portion 11 having holes 12 through which mud may be pumped, as well as arms or blades 13 having pockets 14 into which the PDC cutters are attached. The bit body 10 of FIG. 1 was prepared by powder metal technologies. Typically, to prepare such a bit body, a mold is filled with powdered metals comprising both the binder metal and the carbide. The mold is then compacted to densify the powdered metal and form a green compact. Due to the strength and hardness of sintered cemented carbides, the bit body is usually machined in the green compact form. The green compact may be machined to include any features desired in the final bit body.

The overall durability and performance of fixed-cutter bits depends not only on the durability and performance of the cutting elements, but also on the durability and performance of the bit bodies. It can thus be expected that earth-boring bits based on cemented carbide bit bodies would exhibit significantly enhanced durability and performance compared with bits made using steel or infiltrated bit bodies. However, earth boring bits including solid cemented carbide bit bodies do suffer from limitations, such as the following:

1. It is often difficult to control the positions of the individual PDC cutters accurately and precisely. After machining the insert pockets, the green compact is sintered to further densify the bit body. Cemented carbide bodies will suffer from some slumping and distortion during high temperature sintering processes and this results in distortion of the location of the insert pockets. Insert pockets that are not located precisely in the designed positions of the bit body may not perform satisfactorily due to premature breakage of cutters and/or blades, drilling out-of-round holes, excessive vibration, inefficient drilling, as well as other problems.

2. Since the shapes of solid, one-piece, cemented carbide bit bodies are very complex (see for example, FIG. 1), cemented carbide bit bodies are machined and shaped from green powder compacts utilizing sophisticated machine tools. For example, five-axis computer controlled milling machines. However, even when the most sophisticated machine tools are employed, the range of shapes and designs that can be fabricated are limited due to physical limitations of the machining process. For example, the number of cutting blades and the relative positions of the PDC cutters may be limited because the different features of the bit body could interfere with the path of the cutting tool during the shaping process.

3. The cost of one-piece cemented carbide bit bodies can be relatively high since a great deal of very expensive cemented carbide material is wasted during the shaping or machining process.

4. It is very expensive to produce a one-piece cemented carbide bit body with different properties at different locations. The properties of solid, one-piece, cemented carbide bit bodies are therefore, typically, homogenous, i.e., have similar properties at every location within the bit body. From a design and durability standpoint, it may be advantageous in many instances to have different properties at different locations.

5. The entire bit body of a one-piece bit body must be discarded if a portion of the bit body fractures during service (for example, the breakage of an arm or a cutting blade).

Accordingly, there is a need for improved bit bodies for earth-boring bits having increased wear resistance, strength and toughness that do not suffer from the limitations noted above.

BRIEF DESCRIPTION OF THE FIGURES

The features and advantages of the present invention may be better understood by reference to the accompanying figures in which.

BRIEF SUMMARY

Figure 1:
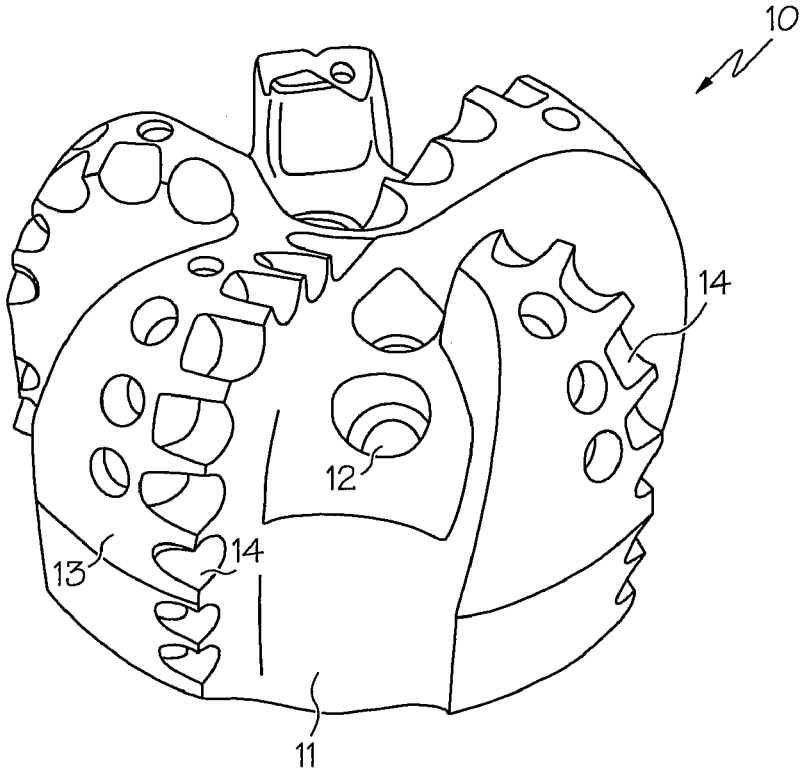
FIG. 1 is a photograph of a conventional solid, one-piece, cemented carbide bit body for earth boring bits.

Certain non-limiting embodiments of the present invention are directed to a modular fixed cutter earth-boring bit body comprising a blade support piece and at least one blade piece fastened to the blade support piece. The modular fixed cutter earth-boring bit body may further comprise at least one insert pocket in the at least one blade piece. The blade support piece, the at least one blade piece, and any other piece or portion of the modular bit body may independently comprise at least one material selected from cemented hard particles, cemented carbides, ceramics, metallic alloys, and plastics.

Further non-limiting embodiments are directed to a method of producing a modular fixed cutter earth-boring bit body comprising fastening at least one blade piece to a blade support piece of a modular fixed cutter earth boring bit body. The method of producing a modular fixed cutter earth-boring bit body may include any mechanical fastening technique including inserting the blade piece in a slot in the blade support piece, welding, brazing, or soldering the blade piece to the blade support piece, force fitting the blade piece to the blade support piece, shrink fitting the blade piece to the blade support piece, adhesive bonding the blade piece to the blade support piece, attaching the blade piece to the blade support piece with a threaded mechanical fastener, or mechanically affixing the blade piece to the blade support piece.

DESCRIPTION OF CERTAIN NON-LIMITING EMBODIMENTS OF THE INVENTION

One aspect of the present invention relates to a modular fixed cutter earth-boring bit body. Conventional earth boring bits include a one-piece bit body with cutting inserts brazed into insert pockets. The conventional bit bodies for earth boring bits are produced in a one piece design to maximize the strength of the bit body. Sufficient strength is required in a bit body to withstand the extreme stresses involved in drilling oil and natural gas wells. Embodiments of the modular fixed cutter earth boring bit bodies of the present invention may comprise a blade support piece and at least one blade piece fastened to the blade support piece. The one or more blade pieces may further include pockets for holding cutting inserts, such as PDC cutting inserts or cemented carbide cutting inserts. The modular earth-boring bit bodies may comprise any number of blade pieces that may physically be designed into the fixed cutter earth boring bit. The maximum number of blade pieces in a particular bit or bit body will depend on the size of the earth boring bit body, the size and width of an individual blade piece, and the application of the earth-boring bit, as well as other factors known to one skilled in the art. Embodiments of the modular earth-boring bit bodies may comprise from 1 to 12 blade pieces, for example, or for certain applications 4 to 8 blade pieces may be desired.

Embodiments of the modular earth-boring bit bodies are based on a modular or multiple piece design, rather than a solid, one-piece, construction. The use of a modular design overcomes several of the limitations of solid one-piece bit bodies.

The bit bodies of the present invention include two or more individual components that are assembled and fastened together to form a bit body suitable for earth-boring bits. For example, the individual components may include a blade support piece, blade pieces, nozzles, gauge rings, attachment portions, shanks, as well as other components of earth-boring bit bodies.

Embodiments of the blade support piece may include, for example, holes and/or a gauge ring. The holes may be used to permit the flow of water, mud, lubricants, or other liquids. The liquids or slurries cool the earth-boring bit and assist in the removal of dirt, rock, and debris from the drill holes.

Embodiments of the blade pieces may comprise, for example, cutter pockets for the PDC cutters, and/or individual pieces of blade pieces comprising insert pockets.

Figure 2:
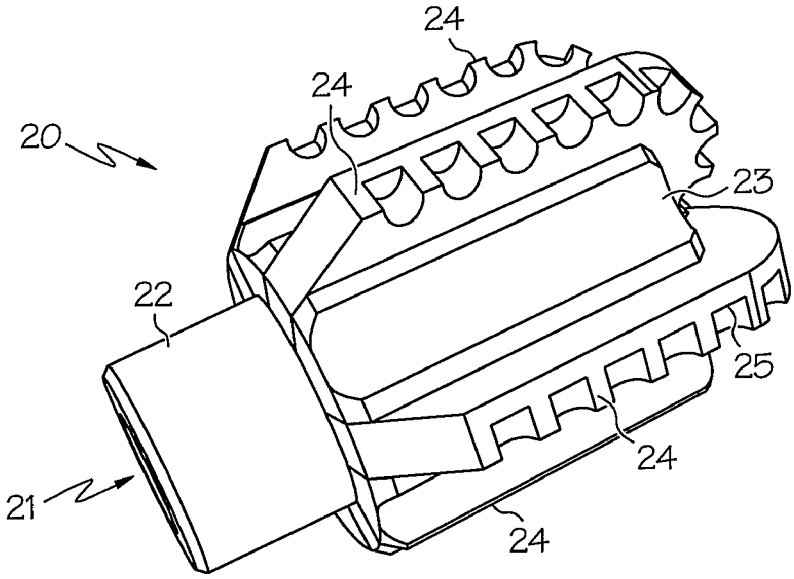
FIG. 2 is photograph of an embodiment of an assembled modular fixed cutter earth-boring bit body comprising six cemented carbide blade pieces fastened to a cemented carbide blade support piece, wherein each blade piece has nine cutting insert pockets.

An embodiment of the modular earth-boring bit body 20 of a fixed cutter earth-boring bit is shown in FIG. 2. The modular earth boring bit body 20 comprises attachment means 21 on a shank 22 of the blade support piece 23. Blades pieces 24 are fastened to the blade support piece 23. It should be noted that although the embodiment of the modular earth boring bit body of FIG. 2 includes the attachment portion 21 and shank 22 as formed in the blade support piece, the attachment portion 21 and shank 22 may also be made as individual pieces to be fastened together to form the part of the modular earth boring bit body 20. Further, the embodiment of the modular earth boring bit body 20 comprises identical blade pieces 24. Additional embodiments of the modular earth boring bit bodies may comprise blade pieces that are not identical. For example, the blade pieces may independently comprise materials of construction including but not limited to cemented hard particles, metallic alloys (including, but limited to, iron based alloys, nickel based alloys, copper, aluminum, and/or titanium based alloys), ceramics, plastics, or combinations thereof. The blade pieces may also include different designs including different locations of the cutting insert pockets and mud holes or other features as desired. In addition, the modular earth boring bit body includes blade pieces that are parallel to the axis of rotation of the bit body. Other embodiments may include blade pieces pitched at an angle, such as 5° to 45° from the axis of rotation.

Figure 3:
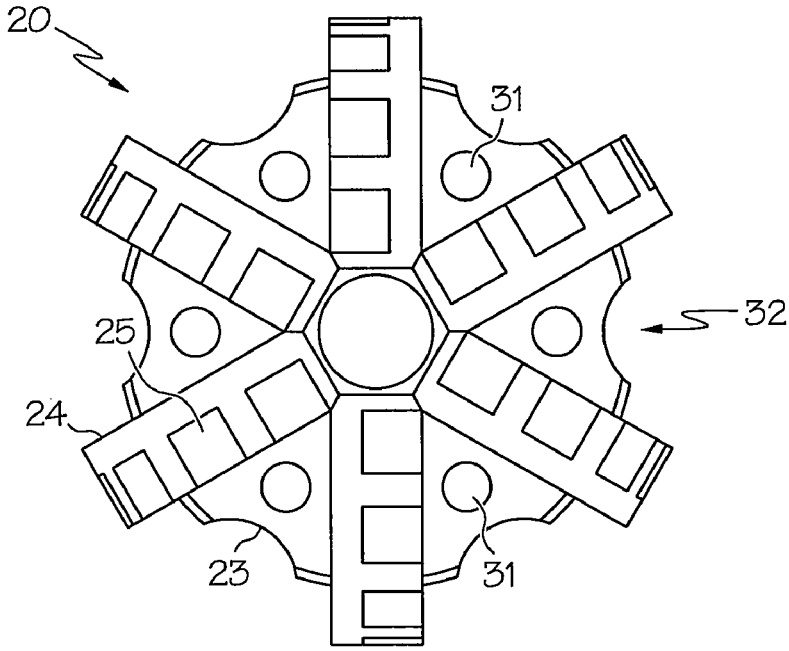
FIG. 3 is a photograph of a top view of the assembled modular fixed cutter earth-boring bit body of FIG. 2.

Further, the attachment portion 21, the shank 22, blade support piece 23, and blade pieces 24 may each independently be made of any desired material of construction that may be fastened together. The individual pieces of an embodiment of the modular fixed cutter earth-boring bit body may be attached together by any method such as, but not limited to, brazing, threaded connections, pins, keyways, shrink fits, adhesives, diffusion bonding, interference fits, or any other mechanical connection. As such, the bit body 20 may be constructed having various regions or pieces, and each region or piece may comprise a different concentration, composition, and crystal size of hard particles or binder, for example. This allows for tailoring the properties in specific regions and pieces of the bit body as desired for a particular application. As such, the bit body may be designed so the properties or composition of the pieces or regions in a piece change abruptly or more gradually between different regions of the article. The example, modular bit body 20 of FIG. 2, comprises two distinct zones defined by the six blade pieces 24 and blade support piece 23. In one embodiment, the blade support piece 23 may comprise a discontinuous hard phase of tungsten and/or tungsten carbide and the blade pieces 24 may comprise a discontinuous hard phase of fine cast carbide, tungsten carbide, and/or sintered cemented carbide particles. The blade pieces 24 also include cutter pockets 25 along the edge of the blade pieces 24 into which cutting inserts may be disposed; there are nine cutter pockets 25 in the embodiment of FIG. 2. The cutter pockets 25 may, for example, be incorporated directly in the bit body by the mold, such as by machining the green or brown billet, or as pieces fastened to a blade piece by brazing or another attachment method. As seen in FIG. 3, embodiments of the modular bit body 20 may also include internal fluid courses 31, ridges, lands, nozzles, junk slots 32, and any other conventional topographical features of an earth-boring bit body. Optionally, these topographical features may be defined by additional pieces that are fastened at suitable positions on the modular bit body.

Figure 4:
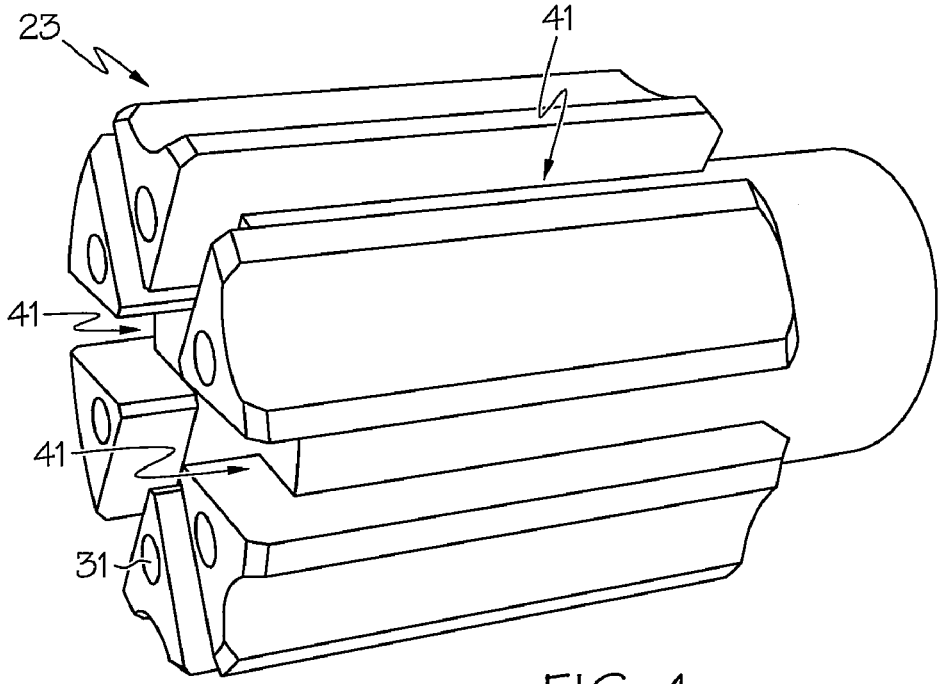
FIG. 4 is a photograph of the blade support piece of the embodiment of the assembled modular fixed cutter earth-boring bit body of FIG. 2 showing the blade slots and the mud holes of the blade support piece.
Figure 5:
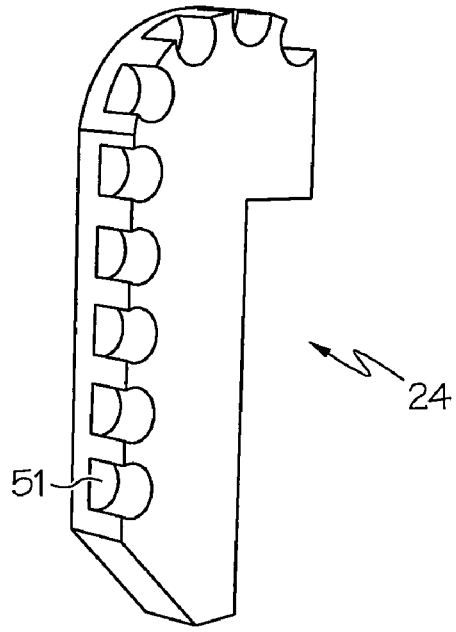
FIG. 5 is a photograph of an individual blade piece of the embodiment of the assembled modular fixed cutter earth-boring bit body of FIG. 2 showing the cutter insert cutter pockets.
Figure 6:
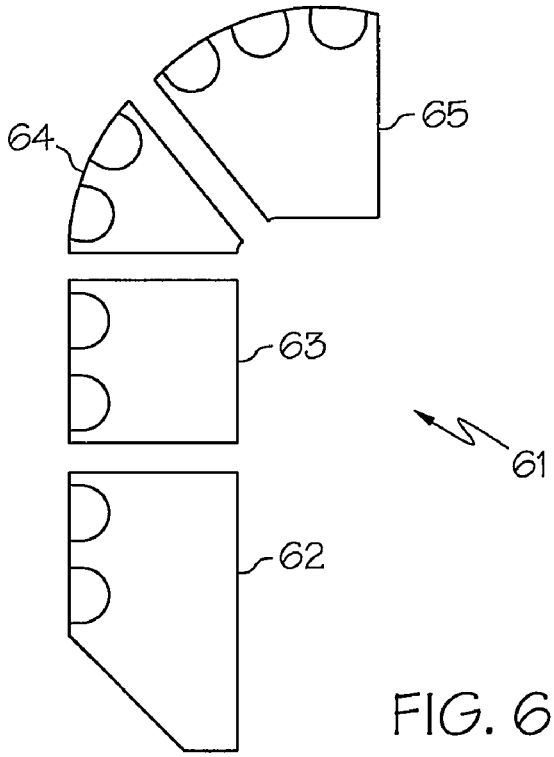
FIG. 6 is a photograph of another embodiment of a blade piece comprising multiple blade pieces that may be fastened in a single blade slot in the blade support piece of FIG. 4.

FIG. 4 is a photograph of the embodiment of the blade support piece 23 of FIGS. 2 and 3. The blade support piece 23 in this embodiment is made of cemented carbides and comprises internal fluid courses 31 and blade slots 41. FIG. 5 is a photograph of an embodiment of a blade piece 24 that may be inserted in the blade slot 41 of blade support piece 23 of FIG. 4. The blade piece 24 includes nine cutter insert pockets 51. As shown in FIG. 6, a further embodiment of a blade piece includes a blade piece 61 comprising several individual pieces 62, 63, 64 and 65. This multi-piece embodiment of the blade piece allows further customization of the blade for each blade slot and allows replacement of individual pieces of the blade piece 61 if a bit body is to be refurbished or modified, for example.

The use of the modular construction for earth boring bit bodies overcomes several of the limitations of one-piece bit bodies, for example: 1) The individual components of a modular bit body are smaller and less complex in shape as compared to a solid, one-piece, cemented carbide bit body. Therefore, the components will suffer less distortion during the sintering process and the modular bit bodies and the individual pieces can be made within closer tolerances. Additionally, key mating surfaces and other features, can be easily and inexpensively ground or machined after sintering to ensure an accurate and precision fit between the components, thus ensuring that cutter pockets and the cutting inserts may be located precisely at the predetermined positions. In turn, this would ensure optimum operation of the earth boring bit during service. 2) The less complex shapes of the individual components of a modular bit body allows for the use of much simpler (less sophisticated) machine tools and machining operations for the fabrication of the components. Also, since the modular bit body is made from individual components, there is far less concern regarding the interference of any bit body feature with the path of the cutting tool or other part of the machine during the shaping process. This allows for the fabrication of far more complex shaped pieces for assembly into bit bodies compared with solid, one-piece, bit bodies. The fabrication of similar pieces may be produced in more complex shapes allowing the designer to take full advantage of the superior properties of cemented carbides and other materials. For example, a larger number of blades may be incorporated into a modular bit body than in a one-piece bit body. 3) The modular design consists of an assembly of individual components and, therefore, there would be very little waste of expensive cemented carbide material during the shaping process. 4) A modular bit body allows for the use of a wide range of materials (cemented carbides, steels and other metallic alloys, ceramics, plastics, etc.) that can be assembled together to provide a bit body having the optimum properties at any location on the bit body. 5) Finally, individual blade pieces may be replaced, if necessary or desired, and the earth boring bit could be put back into service. In the case of a blade piece comprising multiple pieces, the individual pieces could be replaced. It is thus not necessary to discard the entire bit body due to failure of just a portion of the bit body, resulting in a dramatic decrease in operational costs.

The cemented carbide materials that may be used in the blade pieces and the blade support piece may include carbides of one or more elements belonging to groups IVB through VIB of the periodic table. Preferably, the cemented carbides comprise at least one transition metal carbide selected from titanium carbide, chromium carbide, vanadium carbide, zirconium carbide, hafnium carbide, tantalum carbide, molybdenum carbide, niobium carbide, and tungsten carbide. The carbide particles preferably comprise about 60 to about 98 weight percent of the total weight of the cemented carbide material in each region. The carbide particles are embedded within a matrix of a binder that preferably constitutes about 2 to about 40 weight percent of the total weight of the cemented carbide.

In one non-limiting embodiment, a modular fixed cutter earth-boring bit body according to the present disclosure includes a blade support piece comprising a first cemented carbide material and at least one blade piece comprised of a second cemented carbide material, wherein the at least one blade piece is fastened to the blade support piece, and wherein at least one of the first and second cemented carbide materials includes tungsten carbide particles having an average grain size of 0.3 to 10 μm. According to an alternate non-limiting embodiment, one of the first and second cemented carbide materials includes tungsten carbide particles having an average grain size of 0.5 to 10 μm, and the other of the first and second cemented carbide materials includes tungsten carbide particles having an average grain size of 0.3 to 1.5 μm. In yet another alternate non-limiting embodiment, one of the first and second cemented carbide materials includes 1 to 10 weight percent more binder (based on the total weight of the cemented carbide material) than the other of the first and second cemented carbide materials. In still another non-limiting alternate embodiment, a hardness of the first cemented carbide material is 85 to 90 HRA and a hardness of the second cemented carbide material is 90 to 94 HRA. In still a further non-limiting alternate embodiment, the first cemented carbide material comprises 10 to 15 weight percent cobalt alloy and the second cemented carbide material comprises 6 to 15 weight percent cobalt alloy. According to yet another non-limiting alternate embodiment, the binder of the first cemented carbide and the binder of the second cemented carbide differ in chemical composition. In yet a further non-limiting alternate embodiment, a weight percentage of binder of the first cemented carbide differs from a weight percentage of binder in the second cemented carbide. In another non-limiting alternate embodiment, a transition metal carbide of the first cemented carbide differs from a transition metal carbide of the second cemented carbide in at least one of chemical composition and average grain size. According to an additional non-limiting alternate embodiment, the first and second cemented carbide materials differ in at least one property. The at least one property may be selected from, for example, modulus of elasticity, hardness, wear resistance, fracture toughness, tensile strength, corrosion resistance, coefficient of thermal expansion, and coefficient of thermal conductivity.

The binder of the cemented hard particles or cemented carbides may comprise, for example, at least one of cobalt, nickel, iron, or alloys of these elements. The binder also may comprise, for example, elements such as tungsten, chromium, titanium, tantalum, vanadium, molybdenum, niobium, zirconium, hafnium, and carbon up to the solubility limits of these elements in the binder. Further, the binder may include one or more of boron, silicon, and rhenium. Additionally, the binder may contain up to 5 weight percent of elements such as copper, manganese, silver, aluminum, and ruthenium. One skilled in the art will recognize that any or all of the constituents of the cemented hard particle material may be introduced in elemental form, as compounds, and/or as master alloys. The blade support piece and the blade pieces, or other pieces if desired, independently may comprise different cemented carbides comprising tungsten carbide in a cobalt binder. In one embodiment, the blade support piece and the blade piece include at least two different cemented hard particles that differ with respect to at least one property.

Embodiments of the pieces of the modular earth boring bit may also include hybrid cemented carbides, such as, but not limited to, any of the hybrid cemented carbides described in co-pending U.S. patent application Ser. No. 10/735,379, which is hereby incorporated by reference in its entirety.

Conventional cemented carbides are composites of a metal carbide hard phase dispersed throughout a continuous binder phase. The dispersed phase, typically, comprises grains of a carbide of one or more of the transition metals, for example, titanium, vanadium, chromium, zirconium, hafnium, molybdenum, niobium, tantalum and tungsten. The binder phase, used to bind or "cement" the metal carbide grains together, is generally at least one of cobalt, nickel, iron or alloys of these metals. Additionally, alloying elements such as chromium, molybdenum, ruthenium, boron, tungsten, tantalum, titanium, niobium, etc, may be added to enhance different properties. Various cemented carbide grades are produced by varying at least one of the composition of the dispersed and continuous phases, the grain size of the dispersed phase, volume fractions of the phases, as well as other properties. Cemented carbides based on tungsten carbide as the dispersed hard phase and cobalt as the binder phase are the most commercially important among the various metal carbide-binder combinations available.

Embodiments of the present invention include hybrid cemented carbide composites and methods of forming hybrid cemented carbide composites (or simply "hybrid cemented carbides"). Whereas, a cemented carbide is a composite material, typically, comprising a metal carbide dispersed throughout a continuous binder phase, a hybrid cemented carbide may be one cemented carbide grade dispersed throughout a second cemented carbide continuous phase, thereby forming a composite of cemented carbides. The metal carbide hard phase of each cemented carbide, typically, comprises grains of a carbide of one or more of the transition metals, for example, titanium, vanadium, chromium, zirconium, hafnium, molybdenum, niobium, tantalum and tungsten. The continuous binder phase, used to bind or "cement" the metal carbide grains together, is generally cobalt, nickel, iron or alloys of these metals. Additionally, alloying elements such as chromium, molybdenum, ruthenium, boron, tungsten, tantalum, titanium, niobium, etc, may be added to enhance different properties.

In certain embodiments, the hybrid cemented carbides may comprise between about 2 to about 40 vol. % of the cemented carbide grade of the dispersed phase. In other embodiments, the hybrid cemented carbides may comprise between about 2 to about 30 vol. % of the cemented carbide grade of the dispersed phase. In still further applications, it may be desirable to have between 6 and 25 volume % of the cemented carbide of the dispersed phase in the hybrid cemented carbide.

A method of producing a modular fixed cutter earth-boring bit according to the present invention comprises fastening at least one blade piece to a blade support piece. The method may include fastening additional pieces together to produce the modular earth boring bit body including internal fluid courses, ridges, lands, nozzles, junk slots and any other conventional topographical features of an earth-boring bit body.

Fastening an individual blade piece may be accomplished by any means including, for example, inserting the blade piece in a slot in the blade support piece, brazing, welding, or soldering the blade piece to the blade support piece, force fitting the blade piece to the blade support piece, shrink fitting the blade piece to the blade support piece, adhesive bonding the blade piece to the blade support piece (such as with an epoxy or other adhesive), or mechanically affixing the blade piece to the blade support piece. In certain embodiments, either the blade support piece or the blade pieces has a dovetail structure or other feature to strengthen the connection.

The manufacturing process for cemented hard particle pieces would typically involve consolidating metallurgical powder (typically a particulate ceramic and powdered binder metal) to form a green billet. Powder consolidation processes using conventional techniques may be used, such as mechanical or hydraulic pressing in rigid dies, and wet-bag or dry-bag isostatic pressing. The green billet may then be presintered or fully sintered to further consolidate and densify the powder. Presintering results in only a partial consolidation and densification of the part. A green billet may be presintered at a lower temperature than the temperature to be reached in the final sintering operation to produce a presintered billet ("brown billet"). A brown billet has relatively low hardness and strength as compared to the final fully sintered article, but significantly higher than the green billet. During manufacturing, the article may be machined as a green billet, brown billet, or as a fully sintered article. Typically, the machinability of a green or brown billet is substantially greater than the machinability of the fully sintered article. Machining a green billet or a brown billet may be advantageous if the fully sintered part is difficult to machine or would require grinding rather than machining to meet the required final dimensional tolerances. Other means to improve machinability of the part may also be employed such as addition of machining agents to close the porosity of the billet. A typical machining agent is a polymer. Finally, sintering at liquid phase temperature in conventional vacuum furnaces or at high pressures in a SinterHip furnace may be carried out. The billet may be over pressure sintered at a pressure of 300-2000 psi and at a temperature of 1350-1500° C. Pre-sintering and sintering of the billet causes removal of lubricants, oxide reduction, densification, and microstructure development. As stated above, subsequent to sintering, the pieces of the modular bit body may be further appropriately machined or ground to form the final configuration.

One skilled in the art would understand the process parameters required for consolidation and sintering to form cemented hard particle articles, such as cemented carbide cutting inserts. Such parameters may be used in the methods of the present invention.

Additionally, for the purposes of this invention, metallic alloys include alloys of all structural metals such as iron, nickel, titanium, copper, aluminum, cobalt, etc. Ceramics include carbides, borides, oxides, nitrides, etc. of all common elements.

It is to be understood that the present description illustrates those aspects of the invention relevant to a clear understanding of the invention. Certain aspects of the invention that would be apparent to those of ordinary skill in the art and that, therefore, would not facilitate a better understanding of the invention have not been presented in order to simplify the present description. Although embodiments of the present invention have been described, one of ordinary skill in the art will, upon considering the foregoing description, recognize that many modifications and variations of the invention may be employed. All such variations and modifications of the invention are intended to be covered by the foregoing description and the following claims.

The invention claimed is:

1. A modular fixed cutter earth-boring bit body, comprising:

a blade support piece; and at least one blade piece fastened to the blade support piece; wherein each blade piece comprises at least two individual segments.

2. The modular fixed cutter earth-boring bit body of claim 1, wherein the at least one blade piece includes at least one insert pocket.

3. The modular fixed cutter earth-boring bit body of claim 1, wherein the blade support piece comprises at least one material selected from the group consisting of cemented hard particles, cemented carbides, ceramics, metallic alloys, and plastics.

4. The modular fixed cutter earth-boring bit body of claim 3, wherein the at least one blade piece consists essentially of cemented carbide.

5. The modular fixed cutter earth-boring bit body of claim 1, wherein the at least one blade piece comprises at least one material selected from the group consisting of cemented hard particles, cemented carbides, ceramics, metallic alloys, and plastics.

6. The modular fixed cutter earth-boring bit body of claim 5, wherein the blade support piece consists essentially of cemented carbide.

7. The modular fixed cutter earth-boring bit body of claim 1, wherein the blade support piece comprises at least one blade slot and each blade piece is fastened in one blade slot.

8. The modular fixed cutter earth-boring bit body of claim 1, wherein the blade support piece comprises a first cemented carbide and the at least one blade piece comprises a second cemented carbide, and wherein the first cemented carbide and the second cemented carbide differ in at least one property.

9. The modular fixed cutter earth-boring bit body of claim 8, wherein the first cemented carbide and the second cemented carbide individually comprise particles of at least one transition metal carbide in a binder, and wherein the binder independently comprises at least one metal selected from cobalt, nickel, iron, cobalt alloy, nickel alloy, and iron alloy.

10. The modular fixed cutter earth-boring bit body of claim 9, wherein the binder further comprises at least one alloying agent selected from tungsten, titanium, tantalum, niobium, chromium, molybdenum, boron, carbon, silicon, ruthenium, rhenium, manganese, aluminum, and copper.

11. The modular fixed cutter earth-boring bit body of claim 9, wherein the first cemented carbide and the second cemented carbide each comprise 2 to 40 weight percent of binder and 60 to 98 weight percent of transition metal carbide.

12. The modular fixed cutter earth-boring bit body of claim 9, wherein the hardness of the second cemented carbide is from 90 to 94 HRA and the hardness of the first cemented carbide is from 85 to 90 HRA.

13. The modular fixed cutter earth-boring bit body of claim 8, wherein the at least one property is selected from the group consisting of modulus of elasticity, hardness, wear resistance, fracture toughness, tensile strength, corrosion resistance, coefficient of thermal expansion, and coefficient of thermal conductivity.

14. A modular fixed cutter earth-boring bit comprising a modular fixed cutter earth-boring bit body as recited in claim 1.

* * * * *

UNITED STATES PATENT AND TRADEMARK OFFICE

CERTIFICATE OF CORRECTION

PATENT NO. : 8,312,941 B2
APPLICATION NO. : 11/737993
DATED : November 20, 2012
INVENTOR(S) : Mirchandani et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 594 days.

Signed and Sealed this
Twenty-first Day of October, 2014

Michelle K. Lee

Michelle K. Lee
*Deputy Director of the United States Patent and Trademark Office*